US009570816B2

(12) United States Patent
Tao et al.

(10) Patent No.: US 9,570,816 B2
(45) Date of Patent: Feb. 14, 2017

(54) MINIATURE ANTENNA AND ANTENNA MODULE THEREOF

(71) Applicant: Wistron NeWeb Corporation, Hsinchu (TW)

(72) Inventors: Yu Tao, Hsinchu (TW); Chi Ho, Hsinchu (TW); Chia-Wei Sun, Hsinchu (TW); Hsuan-Li Tung, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 92 days.

(21) Appl. No.: 14/702,754

(22) Filed: May 3, 2015

(65) Prior Publication Data

US 2016/0043466 A1 Feb. 11, 2016

(30) Foreign Application Priority Data

Aug. 8, 2014 (TW) ..... 103127380 A

(51) Int. Cl.

| | |
|---|---|
| ***H01Q 21/24*** | (2006.01) |
| ***H01Q 7/00*** | (2006.01) |
| ***H01Q 9/26*** | (2006.01) |
| ***H01Q 21/30*** | (2006.01) |
| ***H01Q 5/371*** | (2015.01) |

(52) U.S. Cl.

CPC ..... *H01Q 21/24* (2013.01); *H01Q 5/371* (2015.01); *H01Q 7/00* (2013.01); *H01Q 9/26* (2013.01); *H01Q 21/30* (2013.01)

(58) Field of Classification Search

CPC ..... H01Q 21/24; H01Q 21/30; H01Q 5/371; H01Q 7/00; H01Q 9/26

USPC ..... 343/700 MS, 702, 725, 726, 727, 741, 343/742, 795, 866, 867

See application file for complete search history.

(56) References Cited

U.S. PATENT DOCUMENTS

| | | | | |
|---|---|---|---|---|
| 2,422,108 | A * | 6/1947 | Luck | G01S 3/143 342/434 |
| 2,953,782 | A * | 9/1960 | Byatt | G01S 1/02 342/428 |
| 2,995,752 | A * | 8/1961 | Shyhalla | G01S 1/02 342/420 |
| 3,474,452 | A * | 10/1969 | Bogner | H01Q 21/29 343/726 |
| 5,426,439 | A * | 6/1995 | Grossman | H01Q 7/00 343/726 |
| 5,751,252 | A * | 5/1998 | Phillips | H01Q 7/00 343/726 |
| 8,319,610 | B2 * | 11/2012 | Chang | G06K 19/07749 340/10.1 |

(Continued)

*Primary Examiner* — Tho G Phan

(74) *Attorney, Agent, or Firm* — Winston Hsu; Scott Margo

(57) ABSTRACT

An antenna includes a feed segment for transmitting a radio-frequency signal, a first radiator electrically connected to the feeding segment and formed on a first surface of a substrate, and a second radiator electrically connected to the feeding segment and formed on a second surface of the substrate, wherein the first radiator includes a first arm electrically connected to the feeding segment, a first branch and a second branch, and a second arm electrically connected to the feeding segment, a third branch and a fourth ranch, and the second radiator includes a third arm electrically connected to the feeding segment, a fifth branch and a sixth branch, and a fourth arm electrically connected to the feeding segment, a seventh branch and an eighth branch.

17 Claims, 14 Drawing Sheets

(56) References Cited

U.S. PATENT DOCUMENTS

| | | | | |
|---|---|---|---|---|
| 2009/0224990 | A1* | 9/2009 | Cezanne | H01Q 1/24<br>343/726 |
| 2013/0044028 | A1 | 2/2013 | Lea | |

* cited by examiner

MINIATURE ANTENNA AND ANTENNA MODULE THEREOF

BACKGROUND OF THE INVENTION

1. Field of the Invention

The present invention relates to a miniature antenna and antenna module thereof, and more particularly, to a miniature antenna and antenna module thereof having an omnidirectional radiation pattern.

2. Description of the Prior Art

Electronic products with wireless communication functionalities utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate a trend for smaller-sized electronic products. Additionally, with the advance of wireless communication technology, electronic products may be configured with an increasing number of antennas. For example, a wireless local area network standard IEEE 802.11n supports multi-input multi-output (MIMO) communication technology, i.e. an electronic product is capable of concurrently receiving/transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality.

As can be seen from the above, a prerequisite for implementing techniques, such as spatial multiplexing, beam forming, spatial diversity, pre-coding, etc., employed in the MIMO communication technology is to employ multiple sets of antenna to divide a space into many channels in order to provide multiple antenna field patterns. Therefore, it is a common goal in the industry to design antennas that suit both transmission demands, as well as dimension and functionality requirements.

SUMMARY OF THE INVENTION

It is therefore an objective of the present invention to provide a miniature antenna and antenna module thereof having an omnidirectional radiation pattern to meet practical requirements.

An embodiment of the present invention discloses an antenna comprising a substrate including a first surface and a second surface, a feed segment formed on the first surface of the substrate for transmitting a radio-frequency signal, a first radiator electrically connected to the feed segment, formed on the first surface of the substrate, and including a first arm having one end electrically connected to the feed segment, and another end electrically connected to a first branch and a second branch, wherein the first arm extends along a first direction from where the end electrically connects to the feed segment, the first branch extends along a second direction from the first arm, and the second branch extends along a third direction from the first arm, and a second arm having one end electrically connected to the feed segment and the first arm, and another end electrically connected to a third branch and a fourth branch, wherein the second arm extends along an opposite of the first direction from the end electrically connected to the feed segment and the first arm, the third branch extends along an opposite of the second direction from the second arm, and the fourth branch extends along an opposite of the third direction from the second arm, and a second radiator electrically connected to the feed segment, formed on the second surface of the substrate, and including a third arm having one end electrically connected to the feed segment, and another end electrically connected to a fifth branch and a sixth branch, wherein the third arm extends along the first direction from the end electrically connected to the feed segment, the fifth branch extends along the third direction from the third arm, and the sixth branch extends along the second direction from the third arm, and a fourth arm having one end electrically connected to the feed segment and the third arm, and another end electrically connected to a seventh branch and an eighth branch, wherein the fourth arm extends along the opposite of the first direction from the end electrically connected to the feed segment and the third arm, the seventh branch extends along the opposite of the third direction from the fourth arm, and the eighth branch extends along the opposite of the second direction from the fourth arm, wherein the second direction is perpendicular to the third direction, and the first direction is a direction that the second direction rotates 135-degrees clockwise.

Another embodiment of the present invention further discloses an antenna module for transmitting and receiving radio-frequency signals corresponding to an operating frequency band, comprising at least one electric dipole antenna, and at least one magnetic loop antenna, wherein one of the at least one magnetic loop antenna is adjacent to one of the at least one electric dipole antenna, wherein the at least one electric dipole antenna and the at least one magnetic loop antenna are disposed within one wavelength of the radio-frequency signals, and a first polarization direction of the at least one magnetic loop antenna is perpendicular to a second polarization direction of the at least one electric dipole antenna.

These and other objectives of the present invention will no doubt become obvious to those of ordinary skill in the art after reading the following detailed description of the preferred embodiment that is illustrated in the various figures and drawings.

DETAILED DESCRIPTION

A ratio of electric field sensitivity and magnetic field sensitivity of an antenna is called a field impedance. At distances greater than one wavelength, the field impedances of small antennas, such as loop antennas, monopole antennas and dipole antennas, are virtually indistinguishable from each other. On the contrary, within a near field region at distances less than one wavelength, the field impedances of the small antennas may vary with distance, direction or angle.

Noticeably, based on characteristics of the field impedance in the near field region, mainly within one tenth wavelength of an operating signal, the small antenna may be categorized into two types of antenna, one is a magnetic loop antenna having a dominant magnetic field and another is an electric dipole antenna having a dominant electric field, wherein the electric and magnetic field sensitivities of the two types of antennas are complementary. For example, the electric dipole antenna has the dominant electric field sensitivity in one tenth wavelength of the operating signals. On the other hand, the magnetic loop antenna has the dominant magnetic field sensitivity in one tenth wavelength of the operating signals.

According to the above mentioned characteristics of the field impedance, the electric dipole antenna and the magnetic loop antenna may respectively induce electric and magnetic components of electromagnetic waves without significant interferences to have a good isolation if the electric dipole antenna and the magnetic loop antenna are simultaneously disposed in the near field region and their polarization directions are orthogonal to each other.

Therefore, in order to reduce the interferences to improve isolations between multiple antennas within a limited antenna space, the present invention configures different types of the small antennas in the near field region according to the characteristics of the complementary electric and magnetic field sensitivities, which minimizes interferences between multiple antennas to maintain data throughput of a MIMO system.

Figure 1:
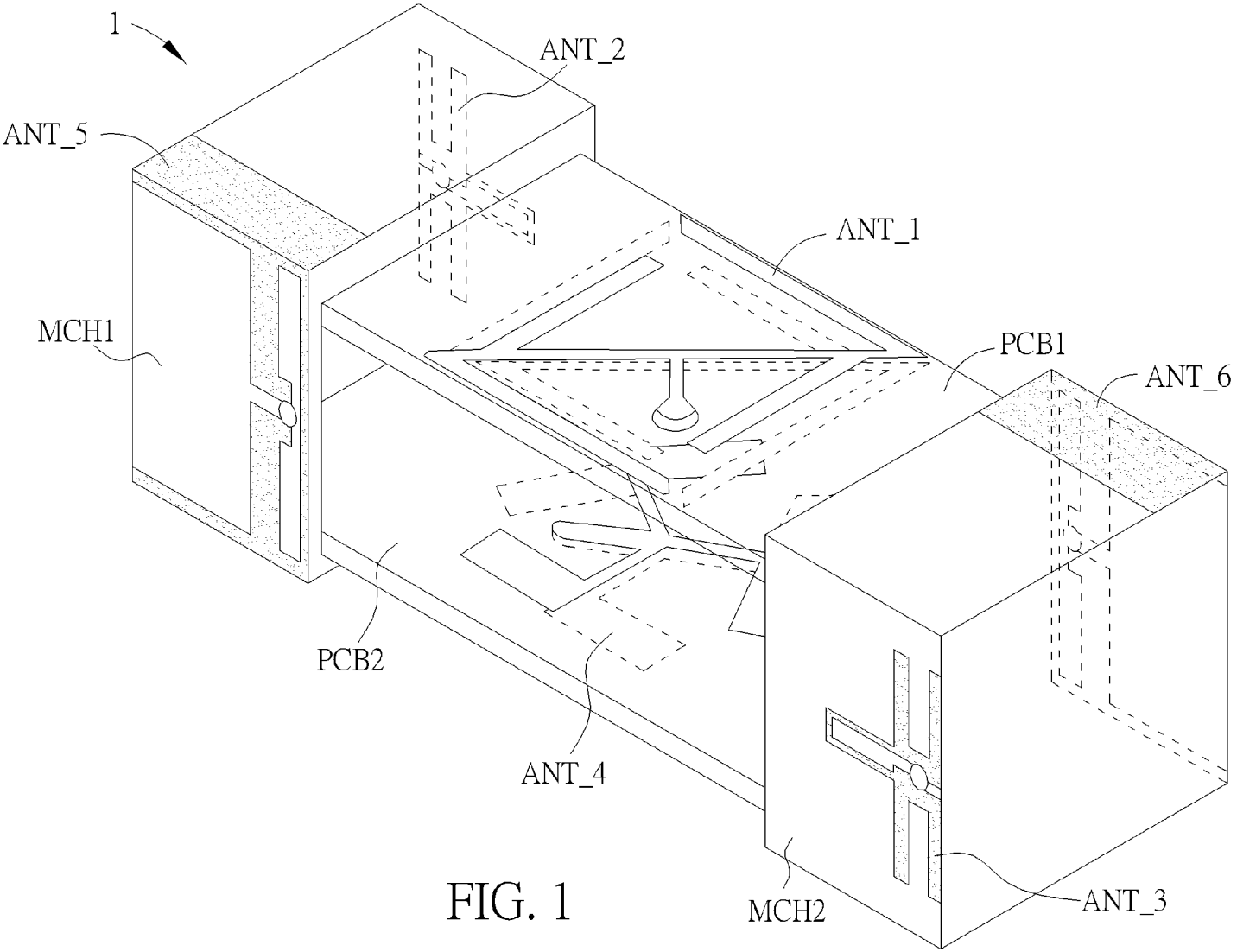
FIG. 1 is a schematic diagram of an antenna module according to an embodiment of the present invention.

Specifically, please refer to FIG. 1, which is a schematic diagram of an antenna module 1 according to an embodiment of the present invention. The antenna module 1 may be utilized in a wireless communication system supporting MIMO technology, such as but not limited to IEEE 802.11n system. The antenna module 1 includes two substrates PCB1 and PCB2, antennas ANT_1 to ANT_6 and two mechanical parts MCH1 and MCH2.

In structure, the mechanical parts MCH1 and MCH2 can be cubes with one opened surface, which allows a part of the substrates PCB1 and PCB2 to be disposed in the cubes, and the substrates PCB1 and PCB2 may be fixed between the mechanical parts MCH1 and MCH2 via hooks and corresponded slots to enhance a combinative stability between the substrates and the mechanical parts. Moreover, the mechanical parts MCH1 and MCH2 and the substrates PCB1 and PCB2 may be fixed together by soldering, adhesive or screws as well, which is not limited. The antennas ANT_1 and ANT_4 are magnetic loop antennas having a horizontal polarization direction. The antennas ANT_2, ANT_3, ANT_5 and ANT_6 are electric dipole antennas having a vertical polarization direction. Of course, polarization directions of the magnetic loop antennas ANT_1 and ANT_4 and the electric dipole antennas ANT_2, ANT_3, ANT_5 and ANT_6 are not limited, as long as the polarization directions of the magnetic loop and electric dipole antennas are orthogonal. In addition, the antennas ANT_1 and ANT_4 may be formed on the substrates PCB1 and PCB2 via printing, and the antennas ANT_2 and ANT_5 and the antennas ANT_3 and ANT_6 may be formed on mechanical parts MCH1 and MCH2 via a Laser Direct Structuring (LDS) technology, respectively. However, methods of forming the antennas are not limited.

For spatial configuration, an antenna sub-module may include the antenna ANT_1 to ANT_3 for transmitting and receiving radio-frequency signals corresponding to an operating frequency band to support a three by three MIMO system, e.g. IEEE 802.11n system in 2.4 GHz frequency band. Another antenna sub-module may include the antennas ANT_4 to ANT_6 for transmitting and receiving radio-frequency signals corresponding to another operating frequency band to support another three by three MIMO system, e.g. IEEE 802.11n system in 5 GHz frequency band. The operating frequency bands of the two antenna sub-modules are different to prevent interfering from the same operating frequency bands. In such a structure, the antenna module 1 is capable of supporting two three by three MIMO systems to increase data throughput.

Please note that, in this embodiment, an antenna configuration of the sole antenna sub-module is configured with one magnetic loop antenna and two electric dipole antennas, which is due to a transmission distance of the electric dipole antenna is farther than that of the magnetic loop antenna in field tests. Hence, considering an overall performance, the antenna configuration with one magnetic loop antenna and two electric dipole antennas may reach a better transmission distance than an antenna configuration with two magnetic loop antennas and one electric dipole antenna.

Furthermore, since the antennas ANT_2 and ANT_3 are the same type of the electric dipole antennas, they are preferred to be placed most distantly, i.e. placed at diagonal corners, to minimize the interference due to being the same type. Meanwhile, since the antenna ANT_1 is the magnetic loop antenna to have a different type from the type of the antennas ANT_2 and ANT_3, the antenna ANT_1 may be disposed between antennas ANT_2 and ANT_3 without significant interferences with adjacent antennas. Likewise, since the antennas ANT_5 and ANT_6 are the same type of the electric dipole antennas, they preferred to be placed most distantly, i.e. placed at another diagonal corners, to minimize the interference due to being the same type. Meanwhile, since the antenna ANT_4 is the magnetic loop antenna to have a different type from the type of the antennas ANT_5 and ANT_6, the antenna ANT_4 may be disposed between the antennas ANT_5 and ANT_6 without significant interferences with adjacent antennas.

Structural designs and operating principles of the electric dipole antennas ANT_2, ANT_3, ANT_5 and ANT_6 are well known in the art, which is omitted for simplicity. Detailed structural designs and operating principles of the magnetic loop antennas ANT_1 and ANT_4 are described in the following description.

Figure 2:
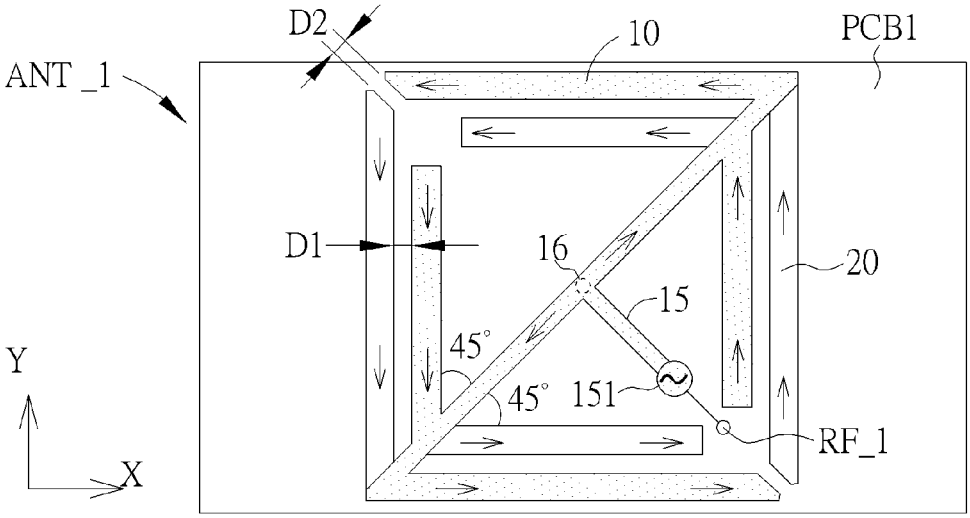
FIG. 2 to FIG. 4 illustrates perspective, top, and bottom views of the antenna shown in FIG. 1, respectively.
Figure 3:
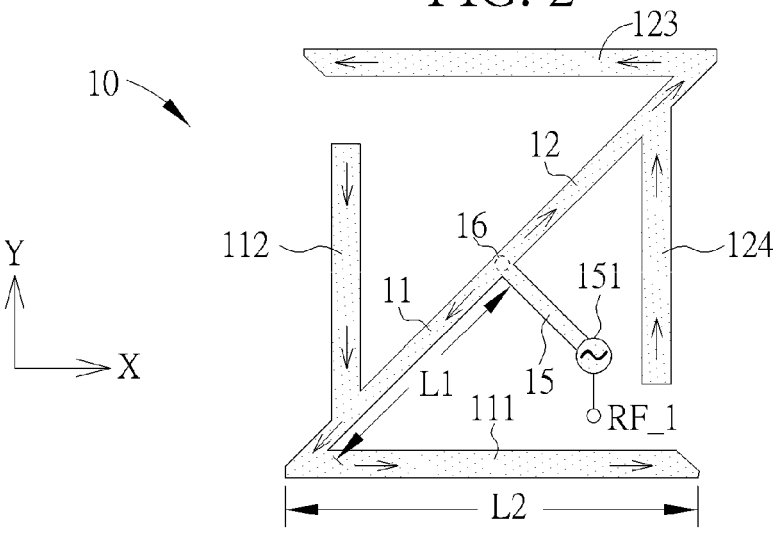
Figure 4:
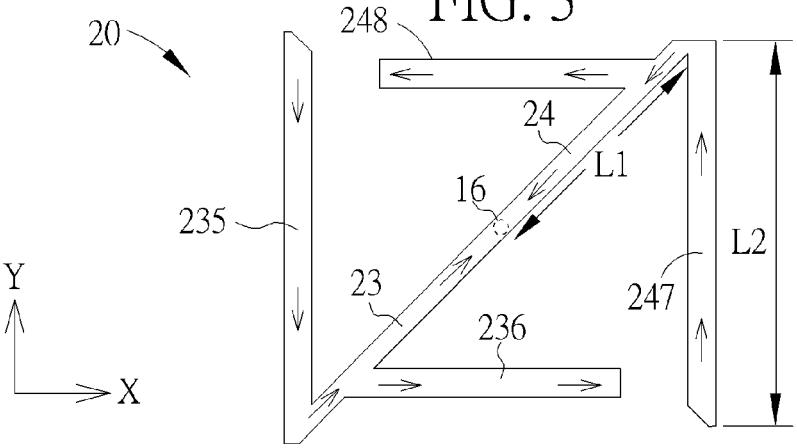

Please refer to FIG. 2 to FIG. 4 at the same time, FIG. 2 illustrates a perspective view of the antenna ANT_1, FIG. 3 illustrates a top view of the antenna ANT_1, and FIG. 4 illustrates a bottom view of the antenna ANT_1, wherein a viewing direction of FIG. 3 and FIG. 4 is the same. As shown in FIG. 2, the antenna ANT_1 includes a feed segment 15, a radiator 10 (denoted with dotted patterns), and a radiator 20 (denoted with blank). One end of the feed segment 15 is electrically connected to a feed terminal 151 for feeding a radio-frequency signal RF_1 to the antenna ANT_1. The radiator 10 is electrically connected to another end of the feed segment 15, and formed on a first surface of the substrate PCB1 (i.e. the top view). The radiator 20 is electrically connected to the another end of the feed segment 15, and formed on a second surface of the substrate PCB1 (i.e. the bottom view). A via 16 is formed in the substrate PCB1 for electrically connecting the radiators 10 and 20, and the feed segment 15.

As shown in FIG. 3, the radiator 10 includes arms 11 and 12 and branches 111, 112, 123 and 124. In structure, the arm 11 includes one end electrically connected to the feed segment 15, and another end electrically connected to the branches 111 and 112, wherein the arm 11 extends from the feed segment 15 along a direction that the direction X rotates 135-degrees clockwise, the branch 111 extends from the arm 11 along the direction X, and branch 112 extends from the arm 11 along the direction Y. One end of the arm 12 is electrically connected to the feed segment 15, another end is electrically connected to the branches 123 and 124, wherein the arm 12 extends from the feed segment 15 along a direction that the direction X rotates 45-degrees counterclockwise, the branch 123 extends from the arm 12 along an opposite of the direction X, and the branch 124 extends from the arm 12 along an opposite of the direction Y. The feed segment 15 extends from where the arms 11 and 12 are connected to the feed terminal 151 along the direction that the direction X rotates 45-degrees counterclockwise, so as to feed the radio-frequency signal RF1.

As shown in FIG. 4, the radiator 20 includes arms 23 and 24 and branches 235, 236, 247, and 248. In structure, one end of the arm 23 may be electrically connected to the feed segment 15 by the via 16, another end may be electrically connected to the branches 235 and 236, wherein the arm 23 extends from the via 16 along the direction that the direction X rotates 135-degrees clockwise, the branch 235 extends from the arm 23 along the direction Y, and the branch 236 extends from the arm 23 along the direction X. One end of the arm 24 may be electrically connected to the feed segment 15 by the via 16, and another end may be electrically connected to the branches 247 and 248, wherein the arm 24 extends from the via 16 along the direction that the direction X rotates 45-degrees counterclockwise, the branch 247 extends from the arm 24 along the opposite of the direction Y, and the branch 248 extends from the arm 24 along the opposite of the direction X.

In a projection plane, the branch 111 is parallel to the branch 236, the branch 112 is parallel to the branch 235, the branch 123 is parallel to the branch 248, and the branch 124 is parallel to the branch 247. The projection plane on which a distance D1 (shown in FIG. 2) is between two of the paralleled branches. The projection plane on which a distance D2 (shown in FIG. 2) is between ends of the branches 123 and 235 and ends of the branches 111 and 247. The projection plane on which the branches 111, 236, 247, and 124 are symmetric to the branches 235, 112, 123, and 248 about a symmetry axis, wherein the symmetry axis extends along the direction that the direction X rotates 45-degrees counterclockwise.

The arms 11, 12, 23, and 24 respectively have a length L1, the branches 111, 123, 235, and 247 respectively have a length L2, and a sum of the lengths L1 and L2 is substantially equal to a quarter wavelength of the radio-frequency signal RF_1. Therefore, the antenna ANT_1 may resonate the radio-frequency signal RF_1 to radiate the radio-frequency signal RF_1 in the air.

In operation, when the radio-frequency signal RF_1 is fed into the antenna ANT_1, a radio-frequency current may flow into two routes from the feed segment 15. One of the routes is flowing along the arm 11 to the end of the branch 111, then being coupled to the branch 247 by a coupling effect, and finally flowing along the arm 24 to return to the feed segment 15. Another route is flowing along the arm 12 to the end of branch 123, then being coupled to the branch 235 by a coupling effect, and finally flowing along the arm 23 to return to the feed segment 15. Meanwhile, with the proper distance D1, the branches 111, 247, 123, and 235 may be coupled to the branches 236, 124, 248, 112 by coupling effects to induce another resonating mode to broaden an operating bandwidth of the antenna ANT_1.

The projection of the arm 11 projected on the second surface of the substrate PCB1 is overlapped with the arm 23, and the projection of the arm 12 projected on the second surface of the substrate PCB1 is overlapped with the arm 24. Radio-frequency currents flowing on the arms 11, 12, 23, and 24 are equal but anti-directional, such that induced magnetic field induced by the radio-frequency currents may be cancelled by each other.

Under the operations mentioned above, the branches 111, 247, 123, and 235 may form an outer current loop, and the branches 236, 124, 248, and 112 may form an inner current loop, wherein the two current loops have a same direction, e.g. clockwise or counter clockwise. Since the branches are symmetric, the two currents loops may be uniformly distributed. In addition, since the magnetic fields induced by the radio-frequency currents on the arms 11, 12, 23, and 24 are cancelled, and an induced magnetic field of an area enclosed by the branches is only provided by the two current loops. Therefore, the antenna ANT_1 may be regarded as a magnetic loop antenna for being disposed adjacent to the electric dipole antenna in the near field region without interfering with each other to reach a good isolation.

Noticeably, in order to make the two current loops of the magnetic loop antenna ANT_1 have the same direction, the two branches electrically connected to the single arm shall be formed at different sides of the arm. Or, from another point of view, take a direction which the arm is extended along as a symmetry axis, the two branches electrically connected to the single arm shall be formed at different sides of the symmetry axis on a plane on which the arm is formed. Take the arm 11 for example, on the first surface of the substrate PCB1, the branches 111 and 112 electrically connected to the arm 11 are respectively formed at different sides of the symmetry axis which extends along the direction that the direction X rotates 135-degrees clockwise. On the contrary, if the two branches electrically connected to the single arm were formed at the same side of the arm, the direction of the inner current loop may be reversed (e.g. clockwise). In such a situation, the directions of the inner and outer current loops may be opposite to cause the induced magnetic fields being cancelled by the two current loops, which reduce the radiation efficiency of the magnetic loop antenna ANT_1.

Figure 5:
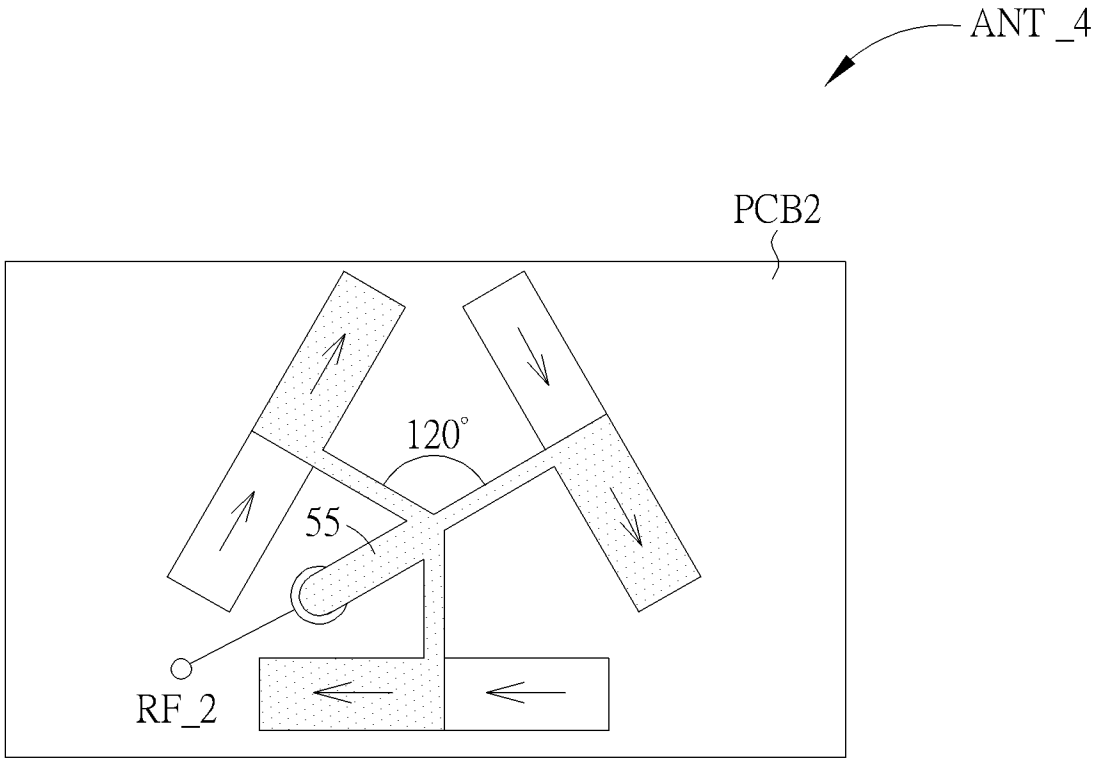
FIG. 5 illustrates a perspective view of another antenna shown in FIG. 1.

Please refer to FIG. 5, which illustrates a perspective view of the antenna ANT_4. As shown in FIG. 5, in structure, the antenna ANT_4 includes a feed segment 55, two radiators denoted with dotted and blank patterns and respectively formed on first and second surfaces of the substrate PCB2. The feed segment 55 is used for feeding a radio-frequency signal RF_2 to the antenna ANT_4. Each of the radiators includes tree arms and tree branches, an angle with 120-degrees is formed between any two adjacent arms. Operations of the antennas ANT_1 and ANT_4 are similar. When the radio-frequency signal RF_2 is fed into the antenna ANT_4, a radio-frequency current may flow into tree routes from the feed segment 55 to the radiator formed on the first surface (denoted with a doted area). Each of the three routes may flow along the arm to ends of the branch, then be coupled to the branches formed on the second surface (denoted with a bank area) by a coupling effect, and finally flow along the arm formed on the second surface to return to the feed segment 55.

Since the arms respectively formed on the first and second surfaces of the substrate PCB2 are overlapped and the radio-frequency currents flowing on the arms are equal but anti-directional, the induced magnetic fields induced by the radio-frequency currents may be cancelled.

Under the operations mentioned above, the tree branches of the antenna ANT_4 may form a current loop, in which a flowing direction of the current loop may be determined according to patterns of the branches, wherein the flowing direction of the current loop is clockwise in this embodiment. The three branches and three arms of the antenna ANT_4 are symmetry about a central point of the antenna ANT_4, which allows the current loops being uniformly distributed. In addition, since the induced magnetic fields induced by the radio-frequency currents of the arms of the antenna ANT_4 may be cancelled, and an induced magnetic field in an area enclosed by the three branches is only provided by the current loop. Therefore, the antenna ANT_4 may be regarded as a magnetic loop antenna for simultaneously being disposed in the near field region with an electric dipole antenna without interfering with each other to reach a good isolation.

In short, the antenna module 1 of the present embodiment may configure the magnetic loop antenna and the electric dipole antenna in the near field region base on characteristics of the field impedance of the small antennas. Under a proper spatial antenna configuration, the magnetic loop antenna and the electric dipole antenna may be configured in the near field region simultaneously, and interferences between the multiple antennas may be minimized. Therefore, the present invention may minimize the interferences between multiple antennas to improve isolations and data throughput of the MIMO system. Those skilled in the art may make modifications and alterations accordingly, which is not limited to the embodiments of the present invention.

For example, a number of antennas configured in the antenna module are not limited, as long as the antenna module is configured with at least one magnetic loop antenna and at least one electric dipole antenna. The antenna module may be configured with one magnetic loop antenna and one electric dipole antenna to support a two by two MIMO system, such as IEEE 802.11a/b/g systems. According to various embodiments, a number of the electric dipole antennas may be greater than a number of the magnetic loop antennas. One of the magnetic loop antennas is adjacent to each of the electric dipole antennas. For example, in the embodiment of the antenna module 1, the magnetic loop antenna ANT_1 is adjacent to each of the electric dipole antennas ANT_2 and ANT_3, wherein each of the electric dipole antennas ANT_2 and ANT_3 is not adjacent to each other.

In addition, antenna patterns of the antenna module are not limited, as long as the antenna configuration of the present invention is met. For example, the electric dipole antenna of the antenna module may be selected from one or more of a dipole antenna, a folded dipole antenna and a shunt-fed dipole antenna, e.g. the antennas ANT_5 and ANT_6 may be the folded dipole antennas, and the antennas ANT_2 and ANT_3 may be the shunt-fed dipole antenna. On the other hand, the magnetic loop antenna of the antenna module may be selected from one or more of the magnetic loop antenna having one radiator with two arms, three arms and four arms, e.g. the antenna ANT_1 may be the magnetic loop antenna having one radiator with two arms, and the antenna ANT_4 may be the magnetic loop antenna having one radiator with three arms.

Figure 6:
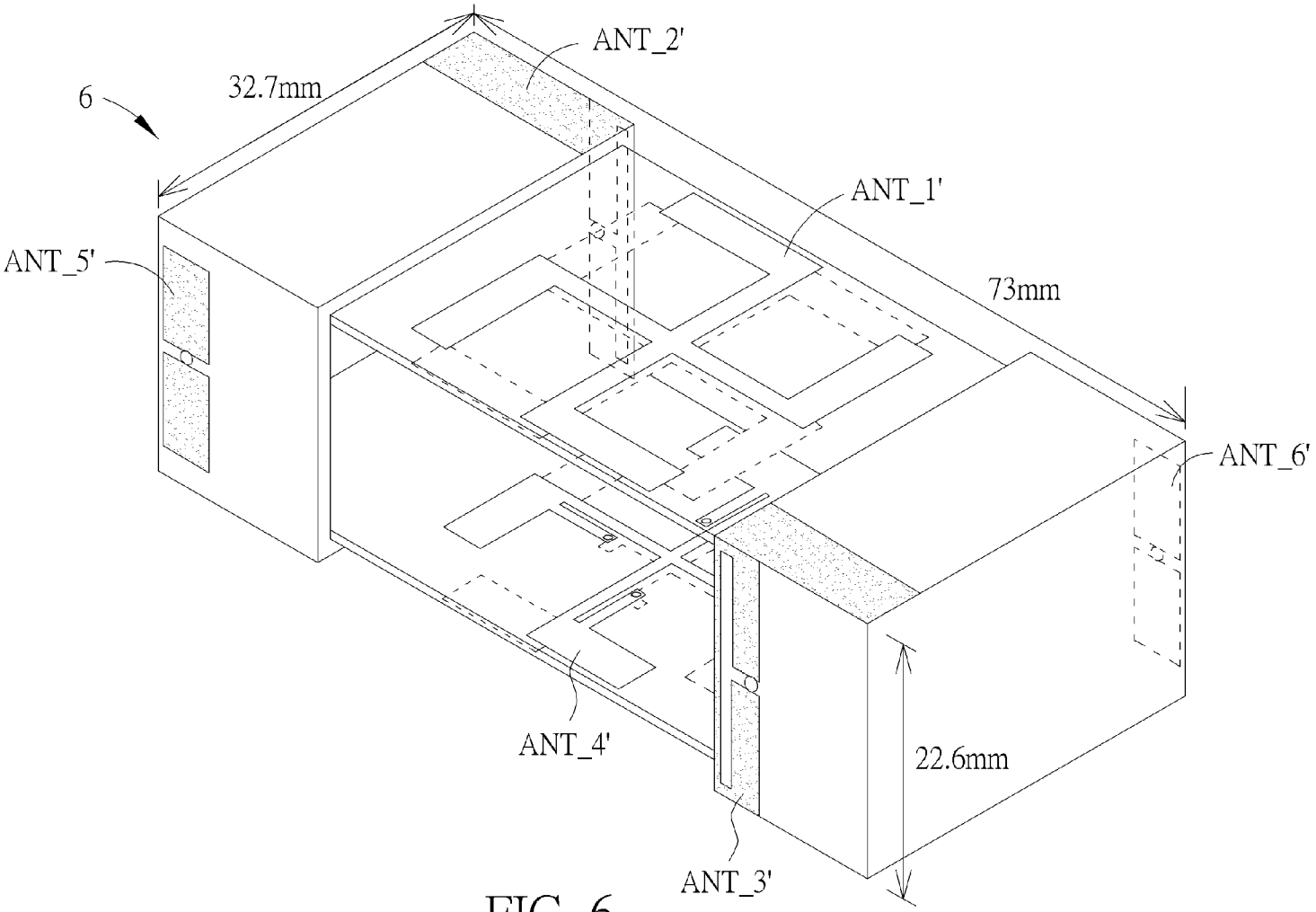
FIG. 6 is a schematic diagram of an antenna module according to another embodiment of the present invention.

Please refer to FIG. 6, which is a schematic diagram of an antenna module 6 according to another embodiment of the present invention. As shown in FIG. 6, antenna modules 6 and 1 have a similar spatial antenna configuration, which may be divided into two antenna sub-modules, each of the antenna sub-modules is configured with one magnetic loop antennas and two electric dipole antennas, and thus the antenna module 6 may support two three by three MIMO systems to improve data throughput. A difference between the antenna modules 1 and 6 is that the antenna module 6 utilizes the magnetic loop antennas ANT_1' and ANT_4' having one radiator with four arms, which is known as a Alford loop antenna, for respectively transmitting and receiving the radio-frequency signals RF_1 and RF_2, for example but not limited to 2.4 GHz and 5 GHz frequency bands of IEEE 802.11n systems. Moreover, the antenna module 6 utilizes the dipole antennas ANT_5' and ANT_6' and the folded dipole antennas ANT_2' and ANT_3'. An antenna dimension of the antenna module 6 is 73 millimeters length, 22.6 millimeters height, and 32.7 millimeters width.

Figure 7:
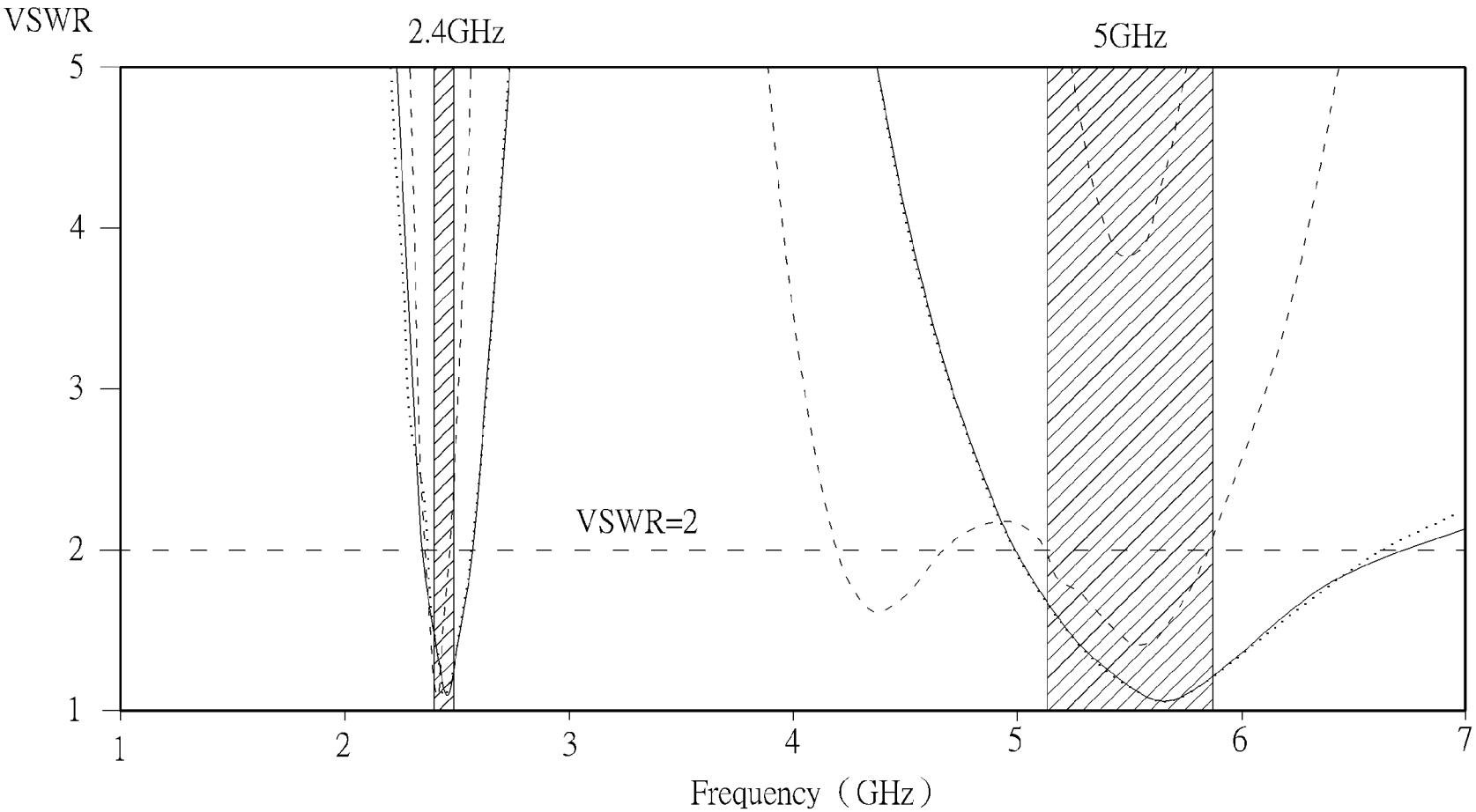
FIG. 7 illustrates voltage standing wave ratios of the antennas shown in FIG. 6.
Figure 8:
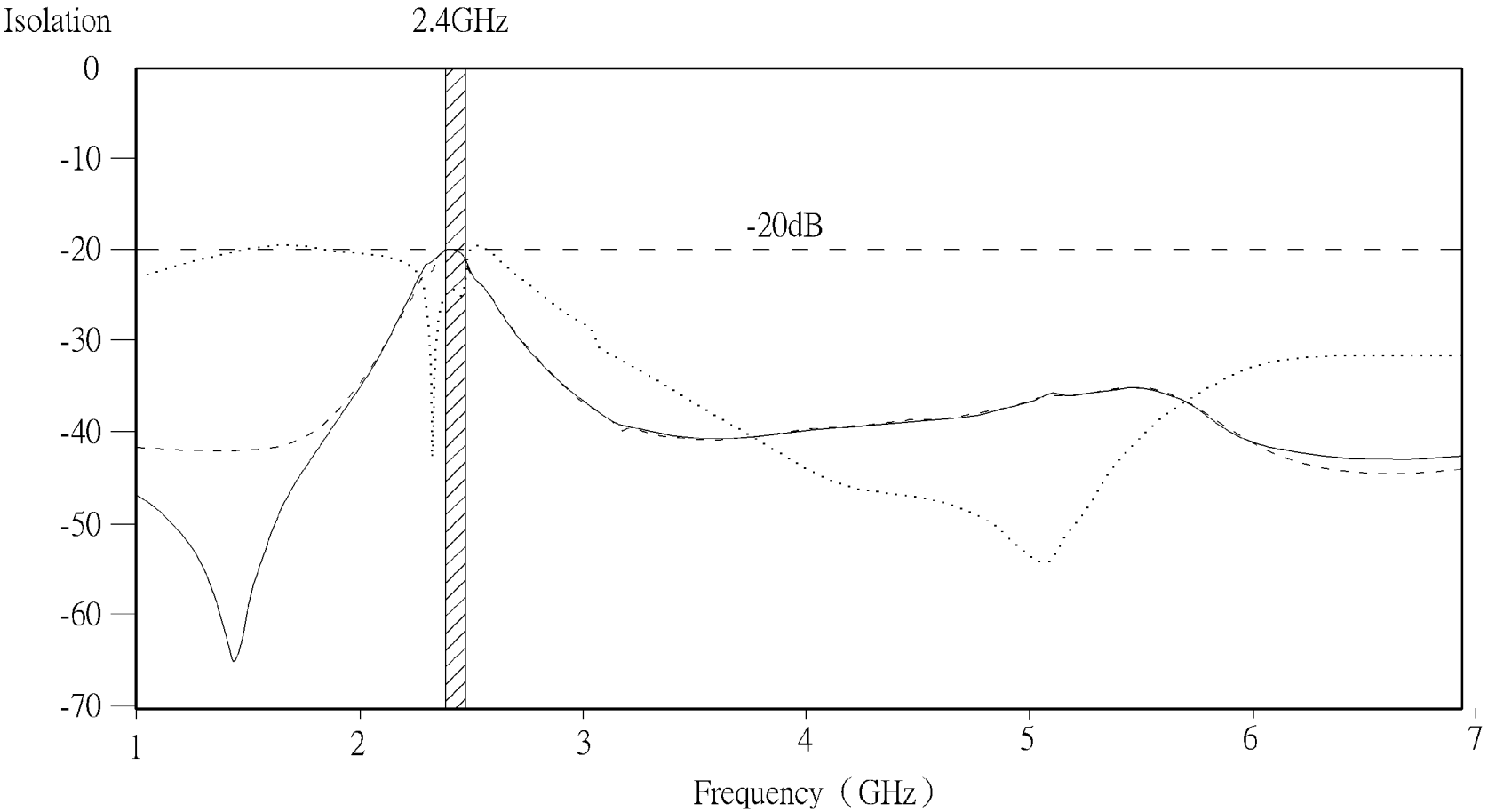
FIG. 8 illustrates isolations between three of the antennas shown in FIG. 6 in the 2.4 GHz frequency band.
Figure 9:
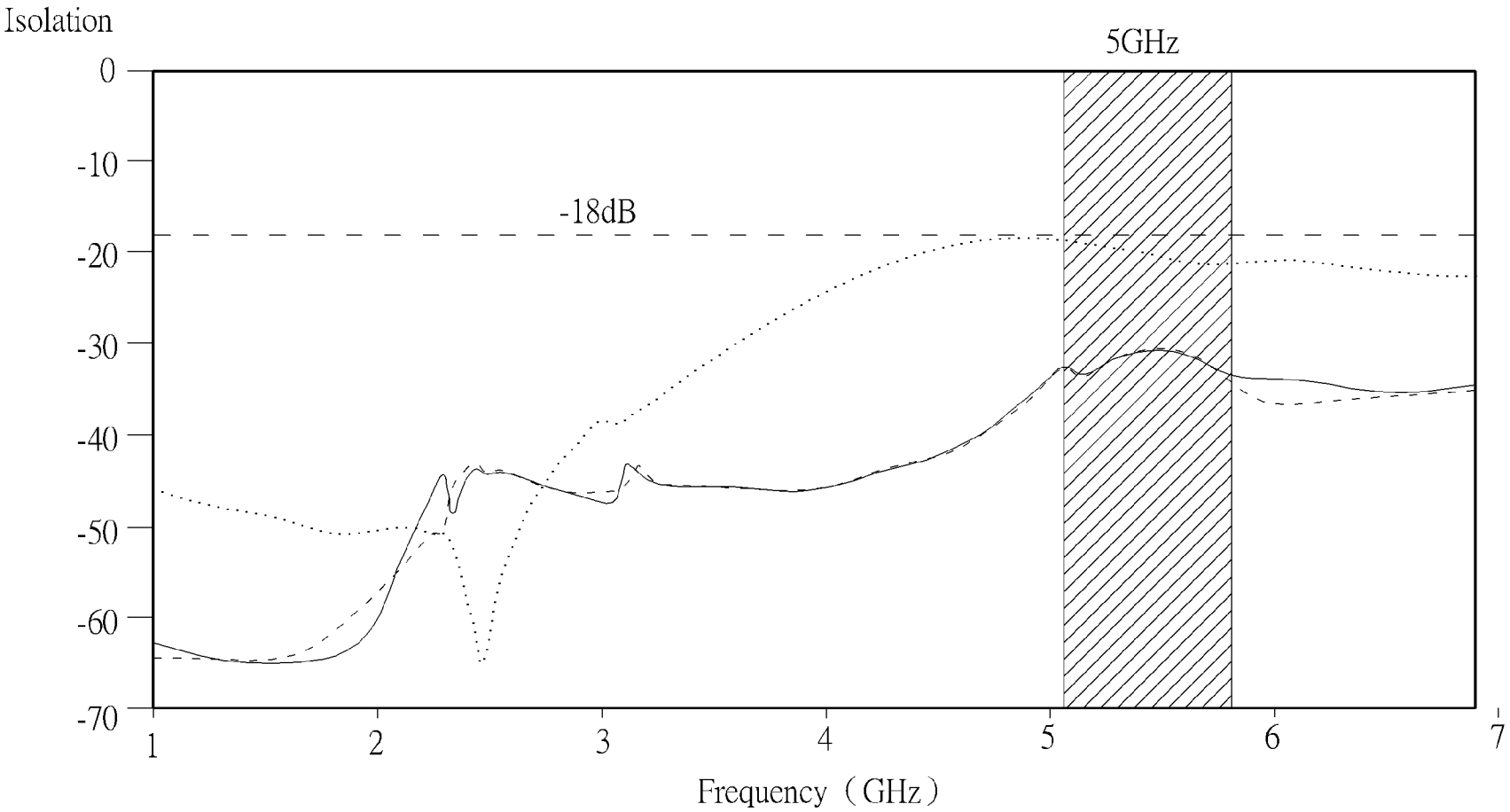
FIG. 9 illustrates isolations between another three of the antennas shown in FIG. 6 in the 5 GHz frequency band.
Figure 10:
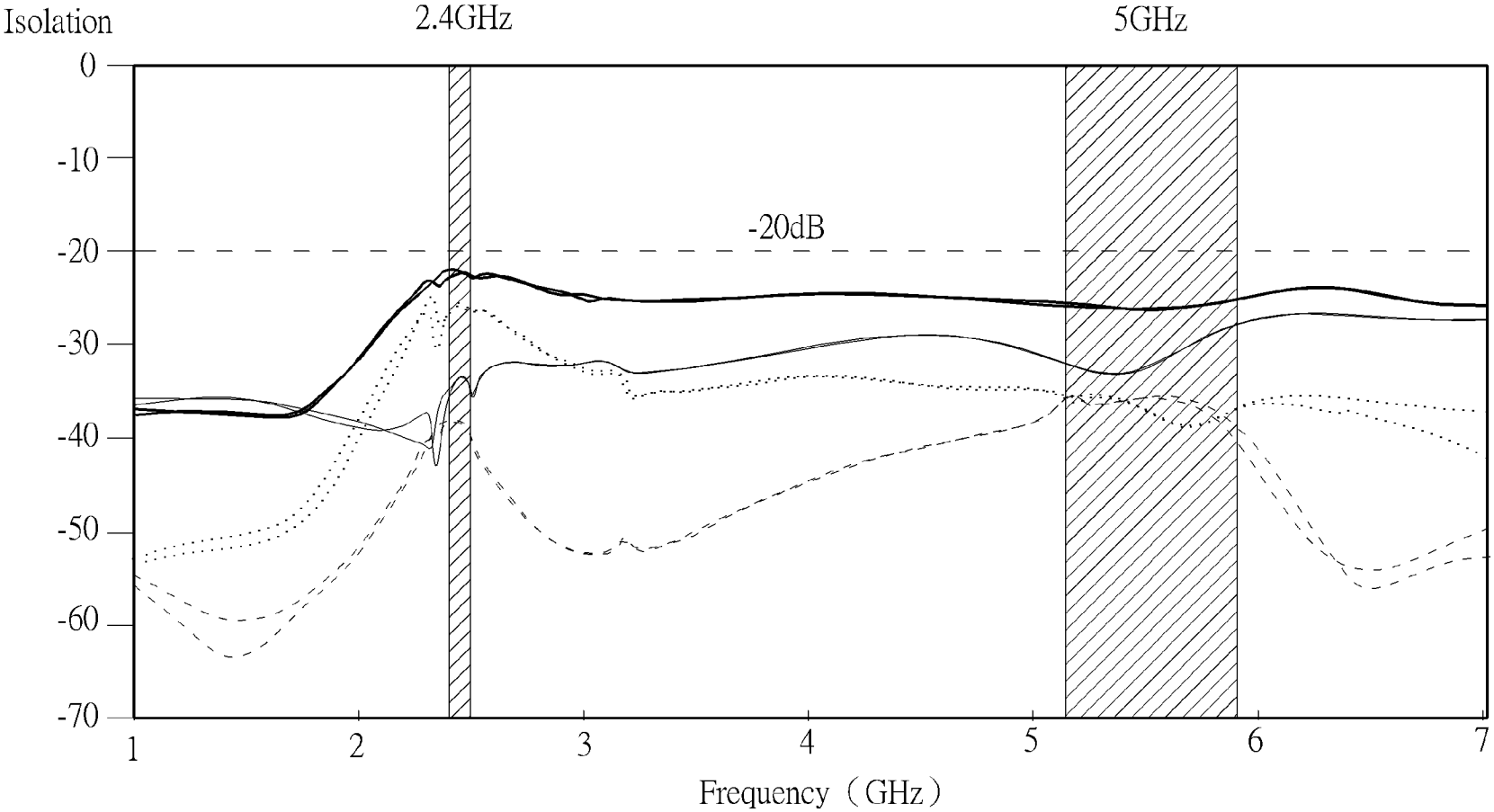
FIG. 10 illustrates isolations between the antennas shown in FIG. 6 in the 2.4 GHz to 5 GHz frequency bands.

Please refer to FIG. 7 to FIG. 10. FIG. 7 illustrates voltage standing wave ratios (hereafter called VSWR) of the antennas ANT_1' to ANT_6'. FIG. 8 illustrates isolations between the antennas ANT_1' to ANT_3' in the 2.4 GHz frequency band. FIG. 9 illustrates isolations between the antennas ANT_4' to ANT_6' in the 5 GHz frequency band. FIG. 10 illustrates isolations between the antennas ANT_1' to ANT_6' in the 2.4 GHz to 5 GHz frequency bands.

In FIG. 7, the VSWRs of the antennas ANT_1' to ANT_3' in the 2.4 GHz frequency band is respectively denoted with a dashed line, a dotted line, and a thin solid line; the VSWRs of the antenna ANT_4' to ANT_6' in the 5 GHz frequency band is respectively denoted with a dashed line, a dotted line, and a thin solid line. As can be seen from FIG. 7, the VSWRs in the 2.4 GHz and 5 GHz frequency bands are less than 2, which means the antennas ANT_1' to ANT_6' are able to operate in both the 2.4 GHz and 5 GHz frequency bands.

In FIG. 8, the isolation between the antennas ANT_1' and ANT_2' is denoted with a dashed line; the isolation between the antennas ANT_2' and ANT_3' is denoted with a dotted line; and the isolation between the antennas ANT_1' and ANT_3' is denoted with a thin solid line. As can be seen from FIG. 8, the isolations between the antennas ANT_1' to ANT_3' belonged to the same antenna sub-module are less than −20 dB in the 2.4 GHz frequency band, which means the isolations between the antennas ANT_1' to ANT_3' are good in the 2.4 GHz frequency band.

In FIG. 9, the isolation between the antennas ANT_4' and ANT_5' is denoted with a dashed line; the isolation between the antennas ANT_5' and ANT_6' is denoted with a dotted line; the isolation between the antennas ANT_4' and ANT_6' is denoted with a thin solid line. As can be seen from FIG. 9, the isolations between the antennas ANT_4' to ANT_6' belonged to the same antenna sub-module are less than −18 dB in the 5 GHz frequency band, which means the isolations between the antennas ANT_4' to ANT_6' are good in the 5 GHz frequency band.

Waveforms of the isolations illustrated on FIG. 10 may be categorized into the following four groups, as shown in Table 1:

TABLE 1

| | Antenna | Isolation (dB) 2.4 GHz | 5 GHz |
|---|---|---|---|
| 1st group | ANT_2' - ANT_5'; ANT_3' - ANT_6' | −22 | −26 |
| 2nd group | ANT_2' - ANT_6'; ANT_3' - ANT_5' | −33 to −36 | −28 to −33 |
| 3rd group | ANT_2' - ANT_4'; ANT_3' - ANT_4' | −26 | −36 to −39 |
| 4th group | ANT_l' - ANT_5'; ANT_l' - ANT_6' | −38 to −40 | −36 to −40 |

Take the isolations between the antennas ANT_3' and ANT_6' in the first group for example (denoted with bolded solid lines), both of the antennas ANT_3' and ANT_6' are electric dipole antennas and disposed close to each other, thereby the isolations between the antennas ANT_3' and ANT_6' are the worst among the four groups in 2.4 GHz and 5 GHz frequency bands. Take the isolations between the antennas ANT_3' and ANT_5' in the second group for example (denoted with thin solid lines), both of the antennas ANT_3' and ANT_5' are electric dipole antennas but disposed away from each other, thereby isolations between the antennas ANT_3' and ANT_5' are better than the isolations between the antennas ANT_3' and ANT_6' in 2.4 GHz and 5 GHz frequency bands. Take the isolations between the antennas ANT_2' and ANT_4' in the third group for example (denoted with dotted lines), though the antennas ANT_2' and ANT_4' are disposed adjacent to each other, the isolations between the antennas ANT_2' and ANT_4' having different types are better than the isolations between the antennas ANT_3' and ANT_6' having the same type.

Take the isolations between the antennas ANT_1' and ANT_5' in the fourth group for example (denoted with dashed lines), the antennas ANT_1' and ANT_5' have different types and operating frequency bands, wherein the antenna ANT_1' operates in 2.4 GHz while the antenna ANT_5' operates in 5 GHz, thereby the isolations between the antennas ANT_1' and ANT_5' are the best among the four groups though the antennas ANT_1' and ANT_5' are disposed adjacent to.

Therefore, as can be seen from the measurement results of FIG. 7 to FIG. 10, the antenna module 6 of the present embodiment may be configured with multiple magnetic loop antennas and multiple electric dipole antennas in the near field region. Under a proper spatial antenna configuration, interferences between the multiple antennas may be minimized. Therefore, the antenna module 6 is able to support two three by three MIMO systems within a limited antenna space to improve data throughput.

Figure 11:
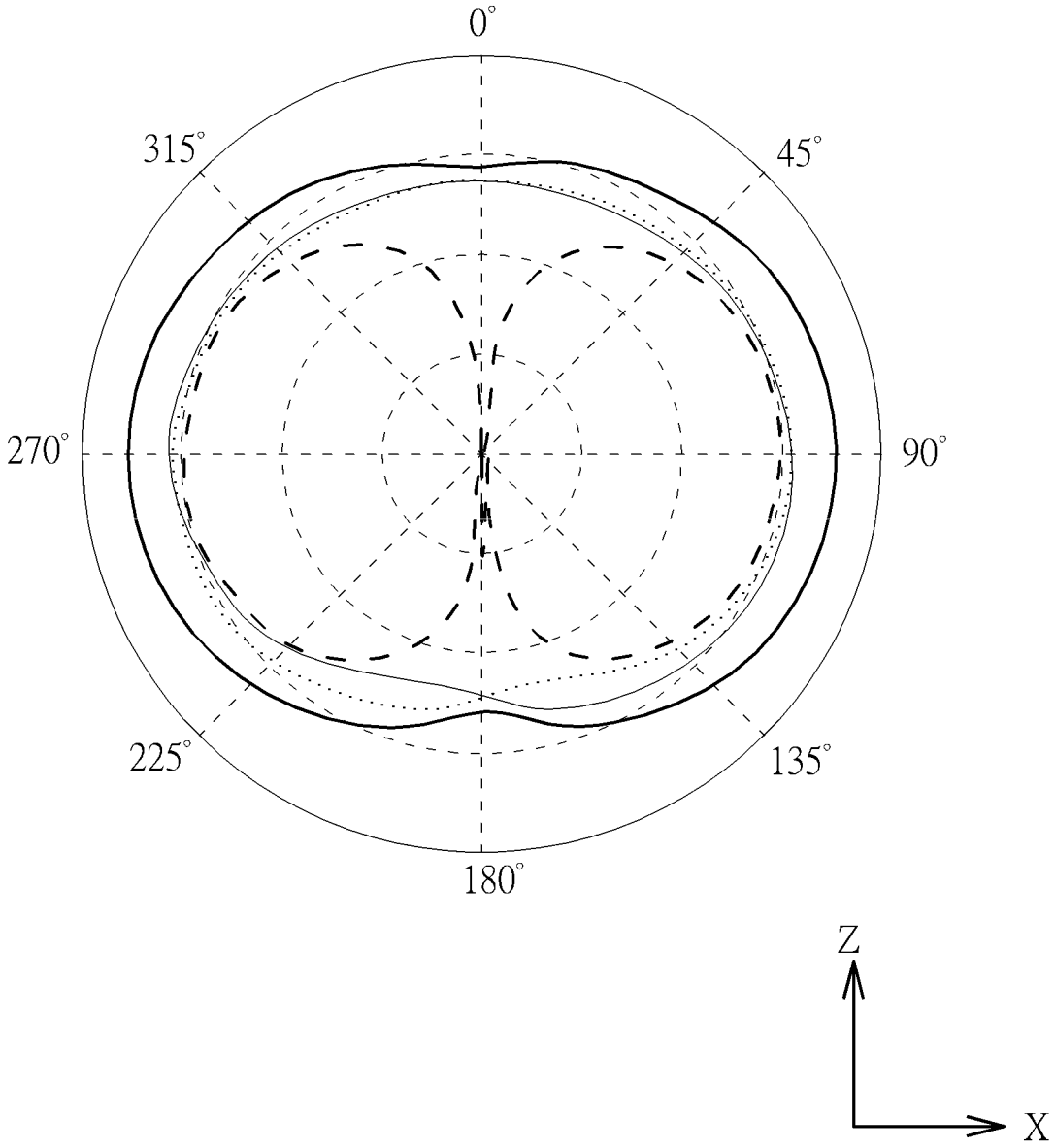
FIG. 11 to FIG. 13 illustrate radiation patterns of three of the antennas shown in FIG. 6 in the 2.4 GHz frequency band, respectively.
Figure 12:
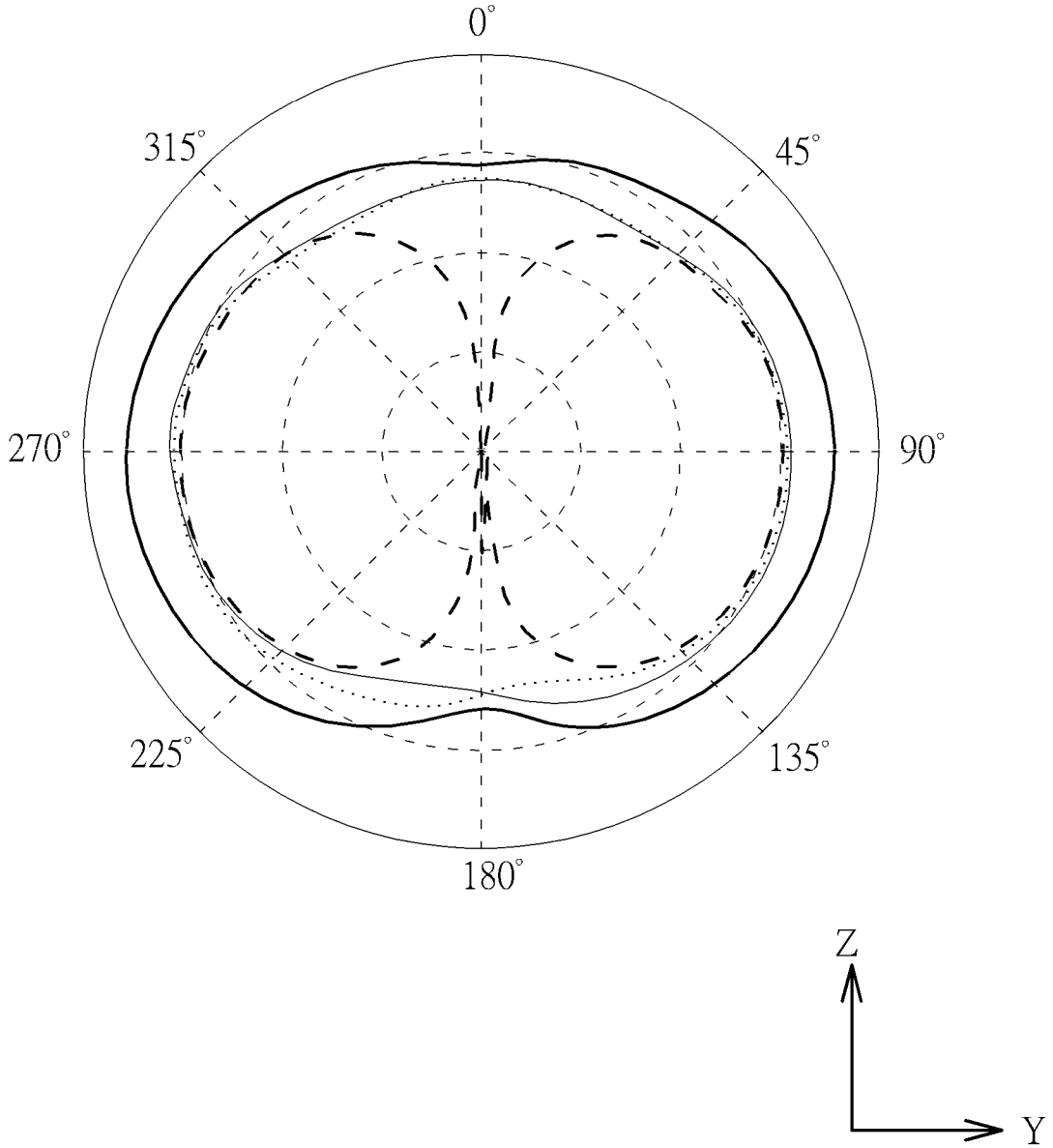
Figure 13:
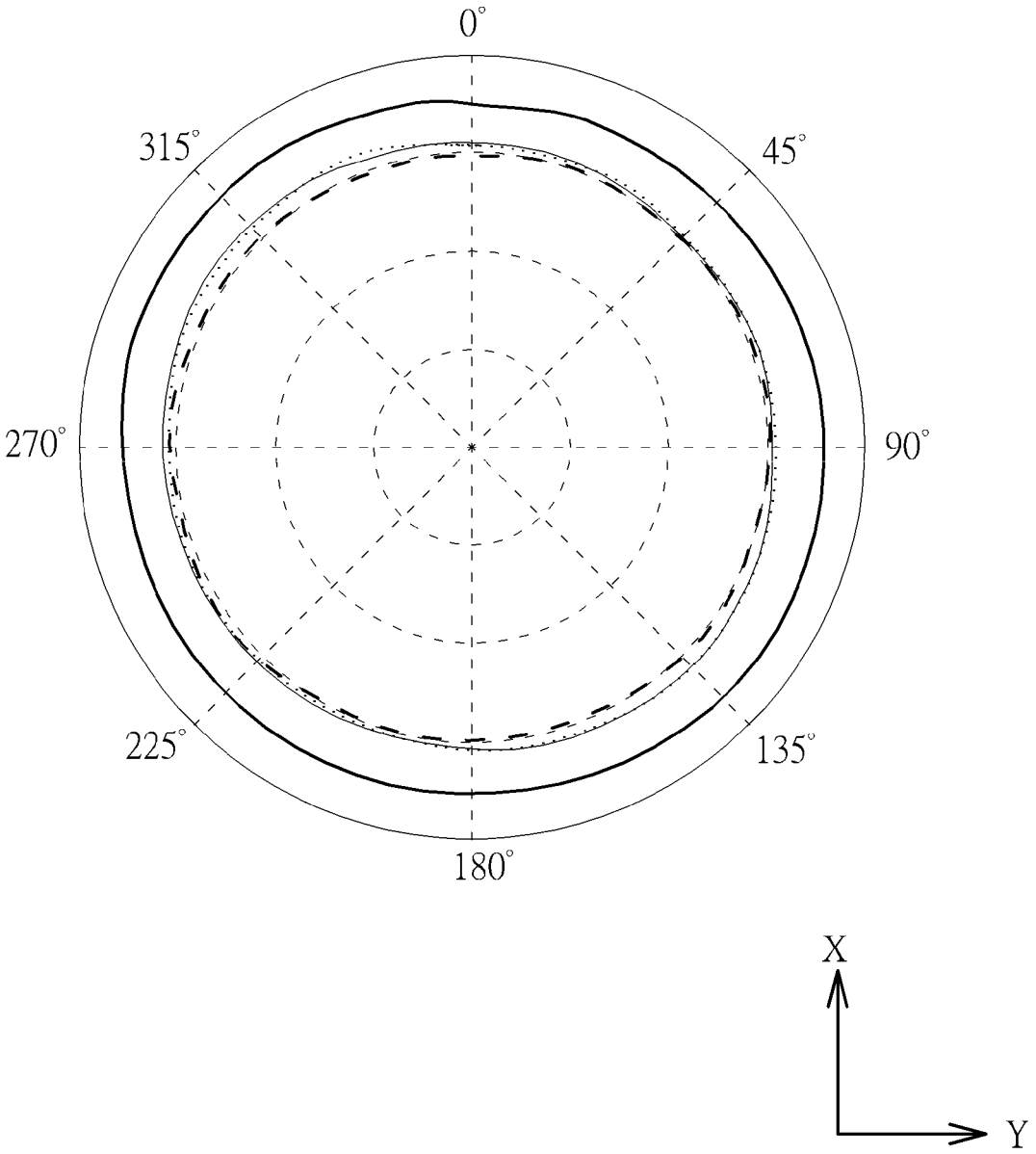

Please refer to FIG. 11 to FIG. 13, which illustrates radiation patterns of the antennas ANT_1', ANT_2, and ANT_3' in the 2.4 GHz frequency band, respectively. The radiation patterns of the antennas ANT_1', ANT_2, and ANT_3' in the 2.4 GHz frequency band are respectively denoted with a bold dashed line, a dotted line and a thin solid line, and a composite radiation pattern of the antennas ANT_1', ANT_2, and ANT_3' is denoted with a bold solid line. As can be seen from FIG. 11 to FIG. 13, the radiation patterns of the electric dipole antennas ANT_2' and ANT_3' are omnidirectional in a vertical plane (i.e. X-Y plane) and horizontal planes (i.e. Y-Z and X-Z planes), and the radiation pattern of the magnetic loop antenna ANT_1' is omnidirectional in the vertical plane. Regard the antennas ANT_1' to ANT_3' as a single antenna sub-module, whose radiation pattern is omnidirectional in the vertical and horizontal planes to have a good radiation efficiency.

Figure 14:
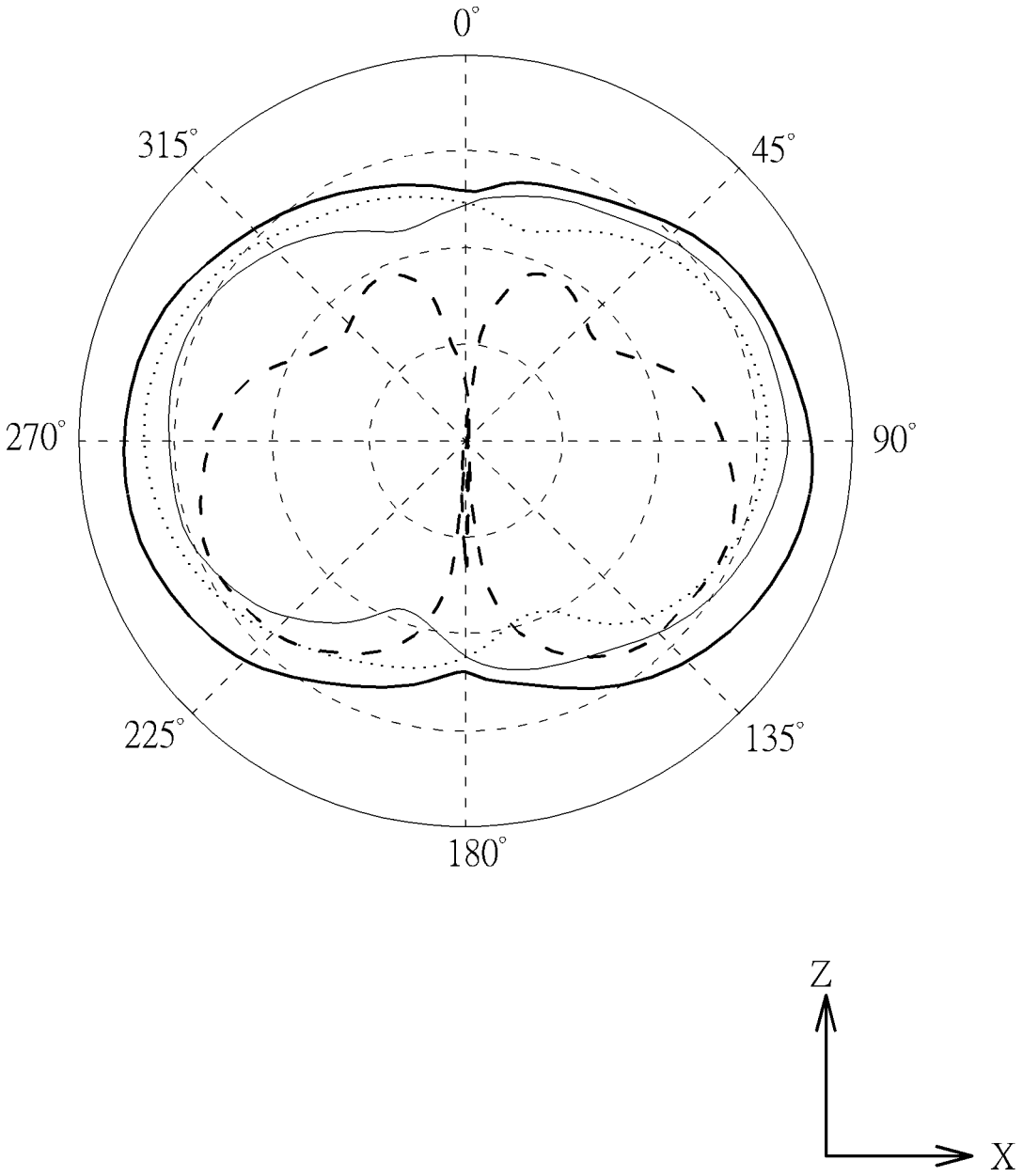
FIG. 14 to FIG. 16 illustrate radiation patterns of another three of the antennas shown in FIG. 6 in 5 GHz frequency band
Figure 15:
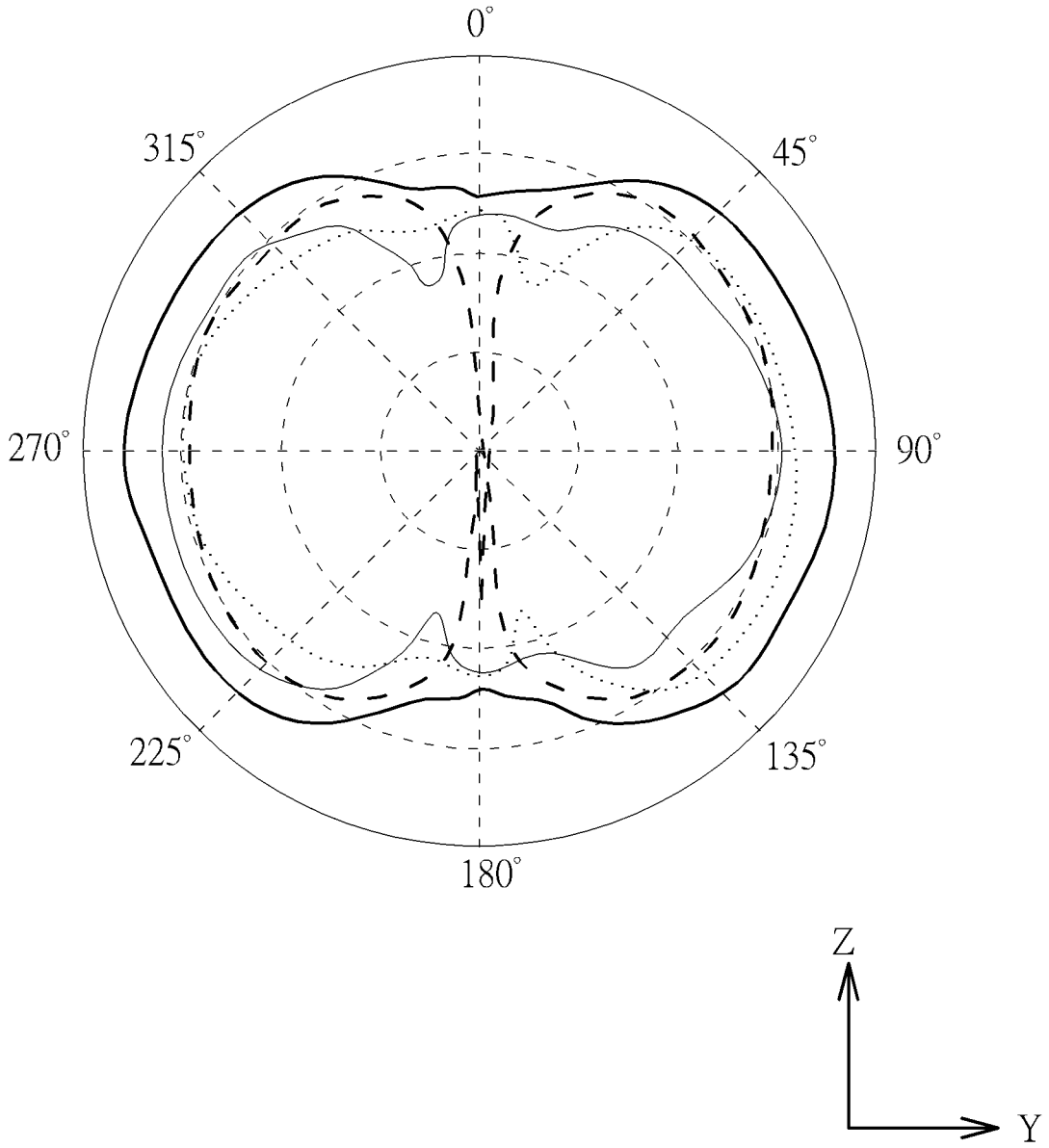
Figure 16:
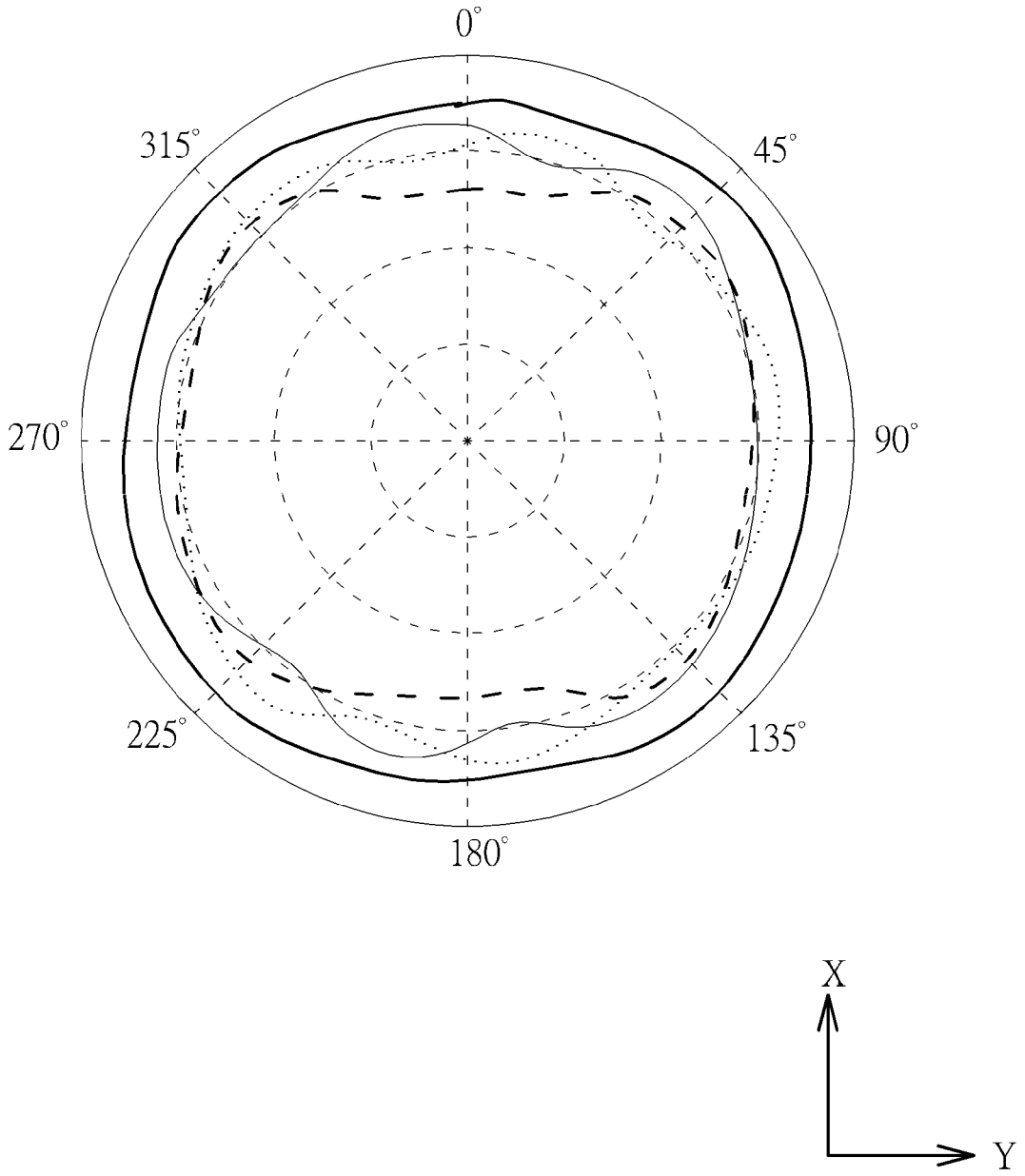

Please refer to FIG. 14 to FIG. 16, which illustrate radiation patterns of the antennas ANT_4' to ANT_6' in 5 GHz frequency band, which is respectively denoted with a thick dashed line, a dotted line, and a thin solid line, and a composite radiation pattern of the antennas ANT_4' to ANT_6' is denoted with a thick solid line. As can be seen from FIG. 14 to FIG. 16, the electric dipole antennas ANT_5' and ANT_6' have omnidirectional radiation patterns in vertical and horizontal planes, and the magnetic loop antenna ANT_4' has an omnidirectional radiation pattern in the vertical plane. Take the antennas ANT_4' to ANT_6' as a sole antenna sub-module, which has composite radiation patterns in the vertical and horizontal planes to reach a good radiation performance.

According to measuring results of FIG. 11 to FIG. 16, average gains (i.e. radiation efficiencies) and peak gains of the antennas ANT_1' to ANT_6' may be obtained as the following Table 2:

TABLE 2

| | Frequency band | | | | | |
|---|---|---|---|---|---|---|
| | 2.4 GHz | | | 5 GHz | | |
| Antenna | ANT_1' | ANT_2' | ANT_3' | ANT_4' | ANT_5' | ANT_6' |
| Average gain (dBi/%) | −1.55/70% | −1.55/70% | −2.22/60% | −1.55/70% | −1.55/70% | −1.55/70% |
| Peak gain (dBi) | 1.70 | 1.71 | 1.41 | 3.78 | 3.75 | 2.20 |

To sum up, the antenna module of the present invention may configure the magnetic loop antenna and the electric dipole antenna in the near field region base on characteristics of the field impedance of the small antennas. Under a proper spatial antenna configuration, the magnetic loop antenna and the electric dipole antenna may be configured in the near field region simultaneously, and interferences between the multiple antennas may be minimized. Therefore, the present invention may minimize the interferences between multiple antennas to improve isolations and data throughput of the MIMO system. Further, the present invention provides the magnetic loop antenna having single radiator and two arms to be employed in the antenna module.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna comprising:

a substrate including a first surface and a second surface;

a feed segment formed on the first surface of the substrate for transmitting a radio-frequency signal;

a first radiator electrically connected to the feed segment, formed on the first surface of the substrate, and including:

a first arm having one end electrically connected to the feed segment, and another end electrically connected to a first branch and a second branch, wherein the first arm extends along a first direction from where the end electrically connected to the feed segment, the first branch extends along a second direction from the first arm, and the second branch extends along a third direction from the first arm; and a second arm having one end electrically connected to the feed segment and the first arm, and another end electrically connected to a third branch and a fourth branch, wherein the second arm extends along an opposite of the first direction from the end electrically connected to the feed segment and the first arm, the third branch extends along an opposite of the second direction from the second arm, and the fourth branch extends along an opposite of the third direction from the second arm; and a second radiator electrically connected to the feed segment, formed on the second surface of the substrate, and including:

a third arm having one end electrically connected to the feed segment, and another end electrically connected to a fifth branch and a sixth branch, wherein the third arm extends along the first direction from the end electrically connected to the feed segment, the fifth branch extends along the third direction from the third arm, and the sixth branch extends along the second direction from the third arm; and a fourth arm having one end electrically connected to the feed segment and the third arm, and another end electrically connected to a seventh branch and an eighth branch, wherein the fourth arm extends along the opposite of the first direction from the end electrically connected to the feed segment and the third arm, the seventh branch extends along the opposite of the third direction from the fourth arm, and the eighth branch extends along the opposite of the second direction from the fourth arm;

wherein the second direction is perpendicular to the third direction, and the first direction is a direction that the second direction rotates 135-degrees clockwise.

2. The antenna of claim 1, wherein a projection of the first arm projected on the second surface of the substrate is overlapped with the third arm, and a projection of the second arm projected on the second surface of the substrate is overlapped with the fourth arm.

3. The antenna of claim 1, wherein, on a projection plane, the first branch is in parallel to the third, sixth, and eighth branches, and the second branch is in parallel to the fourth, fifth, and seventh branches.

4. The antenna of claim 3, wherein the projection plane on which a first distance is between the first and sixth branches, the second and fifth branches, the third and eighth branches, and the fourth and seventh branches.

5. The antenna of claim 3, wherein the projection plane on which a second distance is between ends of the first and seventh branches, and ends of the third and fifth branches.

6. The antenna of claim 3, wherein the projection plane on which the first, sixth, seventh, fourth branches is symmetry to the fifth, second, third, and eighth branches about a symmetry axis, wherein the symmetry axis extends along the first direction.

7. The antenna of claim 6, wherein the first surface of the substrate on which the first and second branches, the third and fourth branches are respectively formed at different sides of the symmetry axis; and the second surface of the substrate on which the fifth and sixth branches, and the seventh and eighth branches are respectively formed at different sides of the symmetry axis.

8. The antenna of claim 1, wherein the feed segment extends along a fourth direction from the first and second arms to a feed terminal, wherein the fourth direction is a direction that the second direction rotates 45-degrees clockwise, and the fourth direction is perpendicular to the first direction.

9. The antenna of claim 1, wherein the first to fourth arms respectively has a first length; the first, third, fifth, and seventh branches respectively has a second length; and a sum of the first and second lengths is substantially equal to a quarter wavelength of the radio-frequency signal.

10. The antenna of claim 1, wherein a via is formed in the substrate for electrically connecting the first and second radiators and the feed segment.

11. The antenna of claim 1, which is a magnetic loop antenna.

12. An antenna module for transmitting and receiving radio-frequency signals corresponding to an operating frequency band, comprising:

at least one electric dipole antenna;

at least one magnetic loop antenna, wherein one of the at least one magnetic loop antenna is adjacent to one of the at least one electric dipole antenna;

wherein the at least one electric dipole antenna and the at least one magnetic loop antenna are disposed within one wavelength of the radio-frequency signals, and a first polarization direction of the at least one magnetic loop antenna is perpendicular to a second polarization direction of the at least one electric dipole antenna;

at least one mechanical part, on which the at least one electric dipole antenna is formed; and at least one substrate, wherein one of the at least one substrate on which one of the at least one magnetic loop antenna is formed;

wherein the at least one mechanical part is an empty cube with one opened surface, and part of the at least one substrate is disposed inside the empty cube through the opened surface.

13. The antenna module of claim 12, wherein the magnetic loop antenna is an Alford loop antenna, or the antenna of claim 1.

14. The antenna module of claim 12, wherein the electric dipole antenna is a dipole antenna, a folded dipole antenna, or a shunt-fed dipole antenna.

15. The antenna module of claim 12, wherein the at least one mechanical part comprises two mechanical parts, and the at least one substrate is fixed between the two mechanical parts.

16. The antenna module of claim 12, wherein the at least one mechanical part and at least one substrate are fixed together by hooks and slots, soldering, adhesive or screws.

17. The antenna module of claim 12, wherein a number of the at least one electric dipole antenna is greater than or equal to a number of the at least one magnetic loop antenna.

* * * * *